US005396664A

United States Patent [19]

King, Jr.

[11] Patent Number: 5,396,664

[45] Date of Patent: Mar. 14, 1995

[54] PORTABLE SPITTLE CUSPIDOR

[76] Inventor: J. Donald King, Jr., 105 Wildcat Cliffs, Anderson, S.C. 29621

[21] Appl. No.: 161,470

[22] Filed: Dec. 6, 1993

[51] Int. Cl.[6] ..... A61J 19/00

[52] U.S. Cl. ..... 4/259; 4/267; 4/283

[58] Field of Search ..... 4/259, 267, 270–285, 4/258

[56] References Cited

U.S. PATENT DOCUMENTS

| | | | |
|---|---|---|---|
| 199,541 | 1/1878 | Heath . | |
| 210,484 | 12/1878 | Archer . | |
| 1,406,472 | 2/1922 | Mintzies | 4/258 |
| 2,126,701 | 8/1938 | Hamilton | 4/258 |
| 2,218,002 | 10/1940 | Hamilton | 4/258 |
| 4,162,547 | 7/1979 | Jenkins | 4/259 |
| 4,503,572 | 3/1985 | Dawson | 4/258 |

FOREIGN PATENT DOCUMENTS

| | | | |
|---|---|---|---|
| 0320765 | 2/1902 | France | 4/281 |
| 0004204 | of 1914 | United Kingdom | 4/267 |

*Primary Examiner*—Charles E. Phillips
*Attorney, Agent, or Firm*—Cort Flint; Gerald R. Boss

[57] ABSTRACT

A portable cuspidor includes a spittle container, a removable funnel section and a cap. A reservoir cap may be used for the storage of tobacco or the like. The removable funnel section is partially suspended within the container by frictionally engaging the inside surface of the spittle container and protruding beyond the periphery of said spittle container remaining within the profile of spittle container providing a streamline cuspidor which is easily portable and which may be placed within the user's pocket. The cap nestles against the outside surface of spittle container for enclosing the interior of spittle container and restricting the outflow of spittle from the spittle container and funnel section.

18 Claims, 3 Drawing Sheets

Fig. 5.
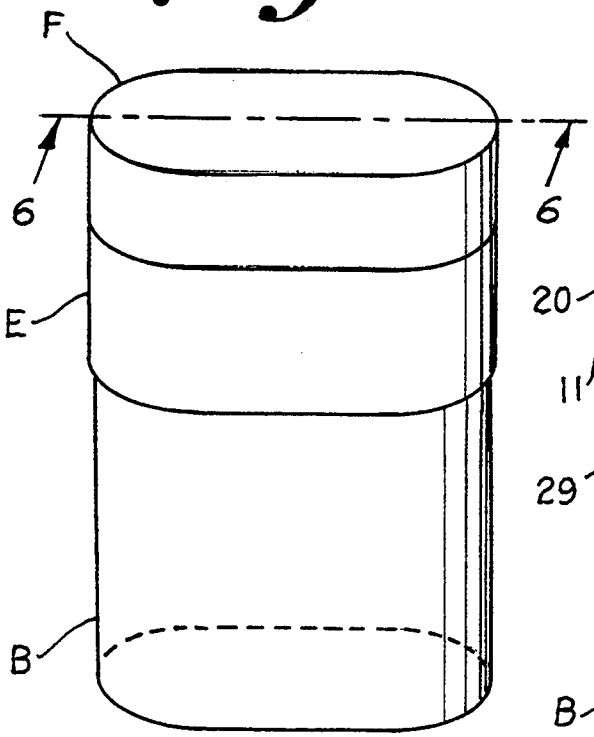
Fig. 3.
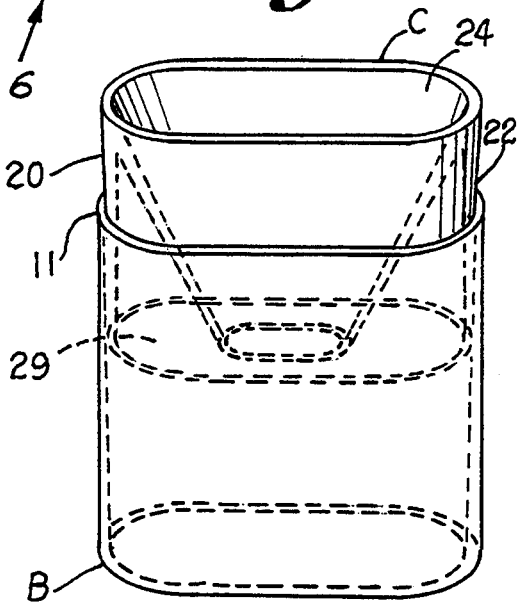
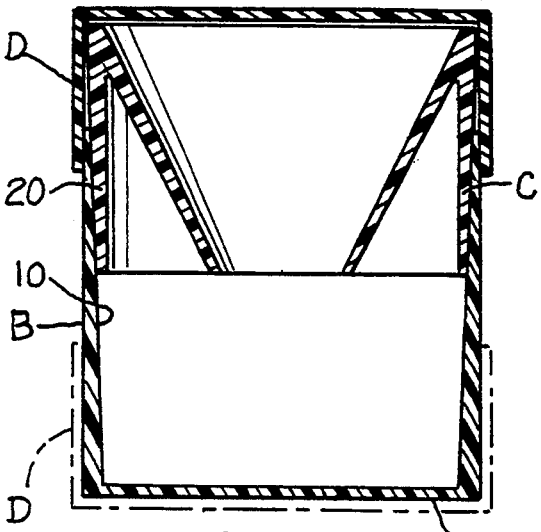
Fig. 4.
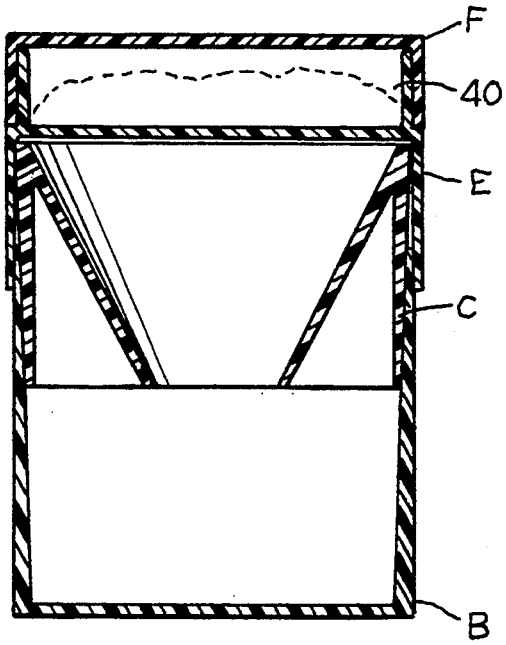
Fig. 6.

PORTABLE SPITTLE CUSPIDOR

BACKGROUND OF THE INVENTION

The invention relates to a spittle cuspidor for the retention of spittle, and more particularly to a portable spittle cuspidor having a spittle container, a removable protruding funnel section enabling the cleaning of the spittle container and a cap for preventing the spillage of retained spittle assembled in a compact fashion facilitating the portability of the cuspidor.

Various configurations of spittle cuspidors have been known at least as early as eighteen seventy-eight. The primary purpose of a cuspidor is to direct spittle from the user to a spittle retainer. This is customarily done through the use of a funnel. Examples of early cuspidors are illustrated in U.S. Pat. Nos. 199,541 and 210,484. Both of these patents disclose a funnel being suspended within a spittle container by resting the funnel on the top of the spittle container. While these structures function in directing the spittle to the spittle container, they were not designed to be portable.

The desire to have a portable cuspidor exists because cuspidor users such as tobacco chewers partake in chewing tobacco, hence creating spittle, in areas where stationary cuspidors are not found. Examples of such a usage occur during the driving of an automobile or the viewing of a movie. U.S. Pat. No. 4,162,547 discloses a pocket cuspidor which utilizes a spittle container received within another second waterproof container. To use this cuspidor, the user removes the spittle container and funnel from a second waterproof container with one hand to place the funnel in an operative position, while the other hand holds the waterproof container. The requirement of using two hands in order to present the funnel in a desirable operative position is unsafe when used while driving. Consequently a design which presents the funnel in a ready to use position is desirable.

Also, U.S. Pat. Nos. 2,126,701 and 4,503,572 disclose cuspidors having a funnel section rim attached to the lip of a spittle container. Both of these inventions are designed to be disposable. Accordingly, the funnel attachment means of having a rim attached to the lip is not designed for repeated disengagement. To disengage the entire circumference of the funnel, the attachment rim must be snapped off of the spittle container. This is cumbersome and may result in the unintentional spillage of spittle and the possibility that the rim may be deformed by the force required to remove the funnel from the container. Hence, should the funnel rim become deformed, then a secure attachment between the funnel rim and the spittle container lip may be hindered. Additionally, such a configuration does not provide the spittle container with a secure means of preventing the spittle container from being deformed by pressure exerted by the user. Should the spittle container be deformed there is a possibility that the rim of the funnel section would become disengaged from the lip of the spittle container.

Accordingly, an object of the present invention is to provide a portable reusable cuspidor which is easy to use and has the funnel in an extended, exposed position;

Additionally, an object of the present invention is to provide a portable cuspidor which can be easily cleaned and used over and over again;

Also, an object of the present invention is to provide a portable cuspidor which is durable and will maintain structural integrity even when an unintentional excessive force is exerted onto the spittle container;

Furthermore, an object of the present invention is to provide a portable cuspidor which is streamline and can be placed in the pocket of the user;

Additionally, an object of the present invention is to provide a portable cuspidor which has a compartment for the storage of tobacco and the like for use by the user.

SUMMARY OF THE INVENTION

The above objectives are accomplished according to the invention by providing a portable reusable cuspidor for the containment of spittle having a hollow elongated spittle container and a removable funnel section suspended within the container by frictionally engaging the inside surface of the spittle container and protruding beyond the periphery of the spittle container. This protrusion provides an exposed surface area enabling the user of the cuspidor to remove the funnel section from the container by grasping the exposed surface area. A cap aids in retaining the spittle within the spittle container by snugly covering the combination of the funnel section and spittle container. The cap may be placed over the bottom of the spittle container when not in use so that it may not be displaced.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a perspective view of the portable cuspidor according to the invention with the funnel section being suspended within the spittle container;

FIG. 4 is a cut away view illustrating the relationship of the components of the portable cuspidor in addition to illustrating the cap being retained over the bottom of the spittle container according to the invention;

FIG. 5 is a perspective view of the portable cuspidor according to the invention;

FIG. 6 is a cut away view along the line 6—6 of FIG. 5 illustrating the relationship of the components of the portable cuspidor with a reservoir cap for containing tobacco according to one embodiment of the invention;

DESCRIPTION OF A PREFERRED EMBODIMENT

Figures 1, 2:
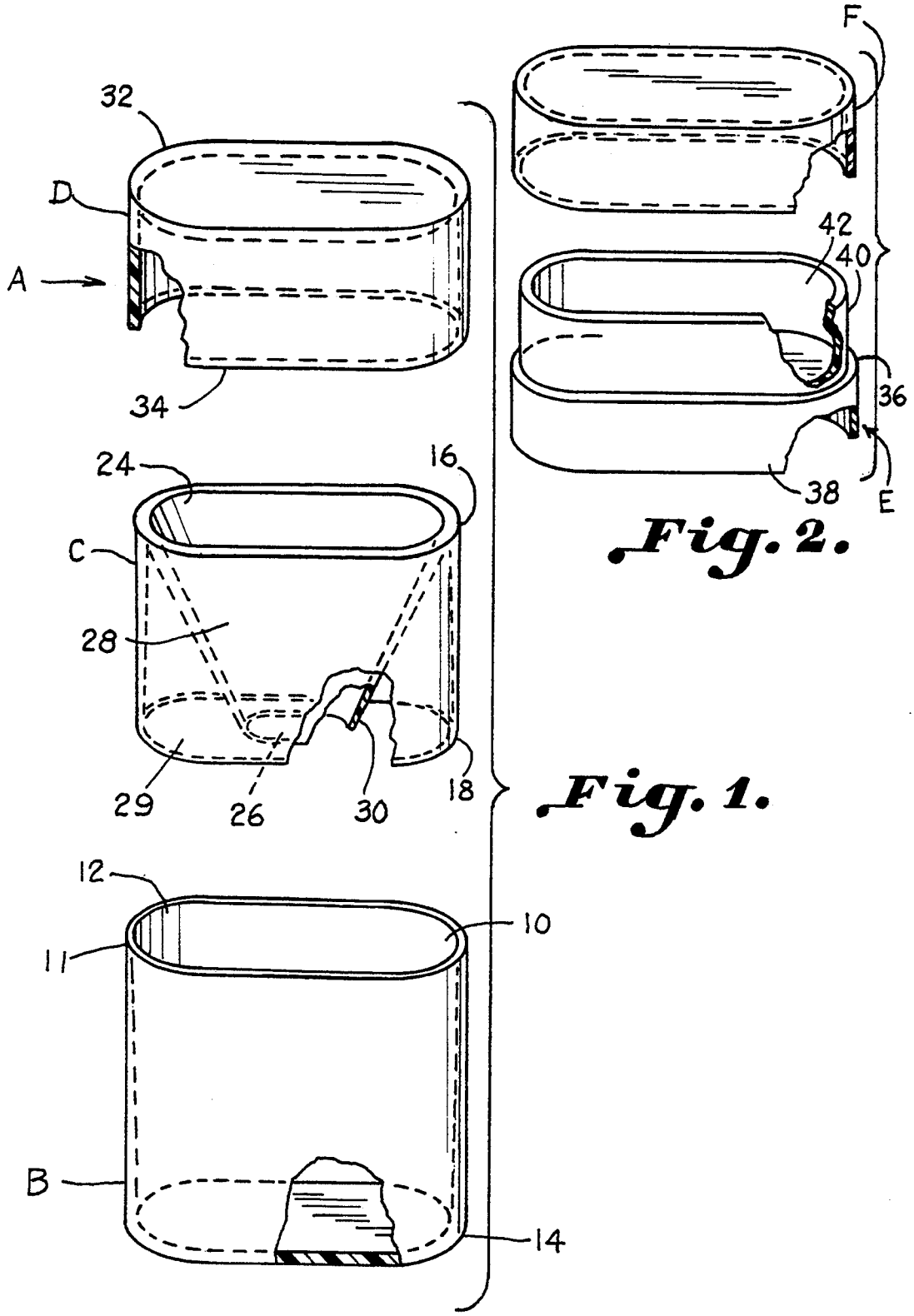
FIG. 1 is an exploded view illustrating the spittle container, the funnel section and cap according to the invention positioned to be nestled together.
FIG. 2 is an exploded view illustrating another embodiment according to the invention having a reservoir cap for the containment of tobacco.
Figure 7:
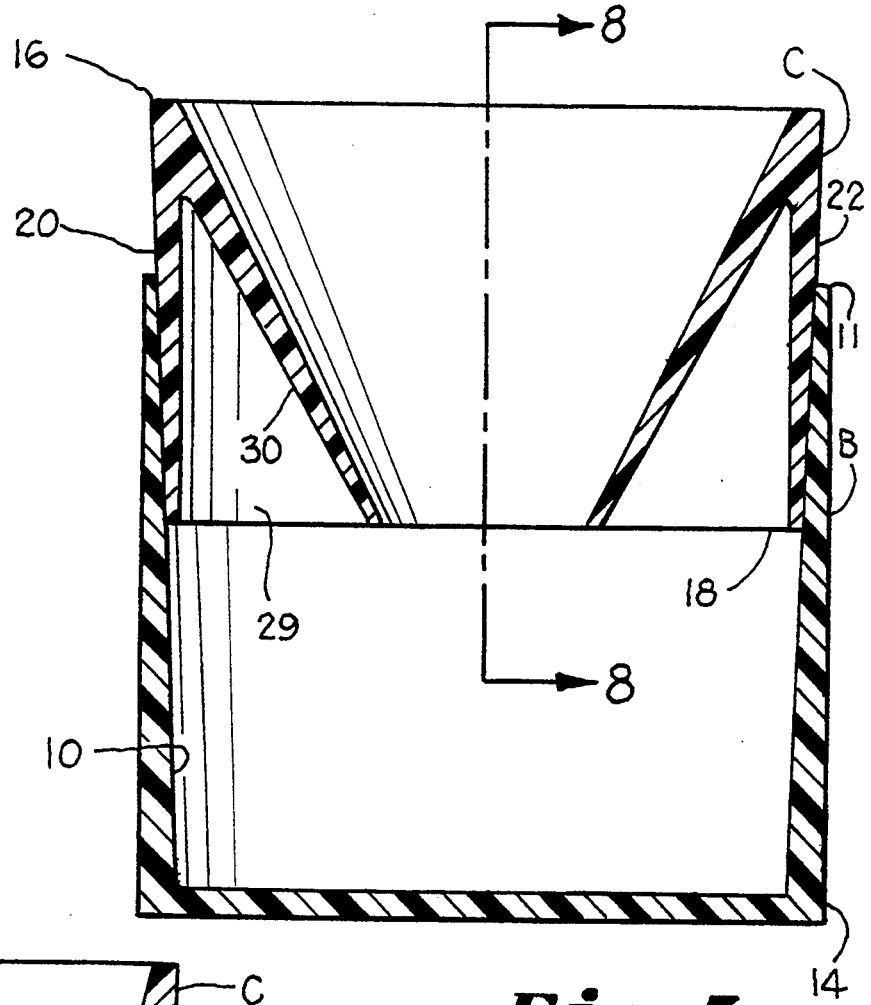
FIG. 7 is a frontal blown up view illustrating the suspension of the funnel section within the spittle container of the portable cuspidor according to the invention.
Figure 8:
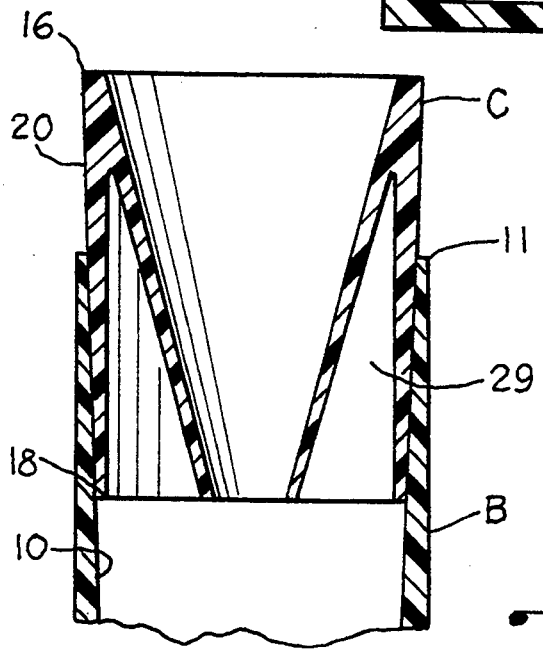
FIG. 8 is a cut away view along the line 8—8 of FIG. 7 illustrating the suspension of the funnel section within the spittle container of the portable cuspidor according to the invention from a side view.

Referring in more detail to the drawings, as shown in FIGS. 1 and 2, a portable cuspidor A includes a spittle container B, a funnel section C and a cap D. As shown in FIG. 2, a reservoir cap E may be used for the storage of tobacco or the like. As shown in FIGS. 3,4,5,6,7 and 8, funnel section C is suspended within the interior of spittle container B and remains within the profile of spittle container B providing a streamline cuspidor which is easily portable and which may be placed within the user's pocket. Also as shown in FIG. 4, cap D nestles against the outside surface of spittle container B for enclosing the interior of spittle container B and restricting the outflow of spittle from spittle container B and funnel section C. FIG. 6 illustrates reservoir cap E nestling against the outside surface of spittle container B for enclosing the interior of spittle container B and restricting the outflow of spittle from spittle container B. In this embodiment, and secondary cap F extends over reservoir cap E for enclosing tobacco and the like within reservoir cap E.

As shown in FIG. 1, spittle container B is of a given width having a hollow interior with an inside surface 10. Spittle container B includes a top 11 defining an aperture 12 and a base 14 for receiving and containing said spittle. As shown in FIGS. 4,5,7 and 8, inside surface 10 is tapered so that the inside width of spittle container B is wider at top 11 than base 14.

As shown in FIG. 1, removable funnel section C includes a top end 16 and a bottom end 18. At least one exterior funnel wall 20 interconnects top end 16 with bottom end 18. As shown in FIGS. 4,6,7 and 8, exterior funnel wall 20 is tapered so that the outside width of funnel section C is wider at top end 16 than bottom end 18. This configuration enables funnel section C to be partially suspended within spittle container B by exterior funnel wall 20 frictionally engaging inside surface 10 of said spittle container B. This frictional engagement in combination with the tapering of both funnel section C and spittle container B secures funnel section C firmly within spittle container B thus enhancing the portability of cuspidor A by maintaining a firm, solid embodiment. Additionally, the combination of surface area provides for a strong structure which prevents the deforming of spittle container B when grasped by a user.

As shown in FIGS. 3,4,6,7 and 8, the taper of funnel section C is such that the outside width of exterior funnel wall 20 eventually becomes wider than the taper of inside surface 10 of spittle container B. Accordingly resulting in top end 16 of funnel section C protruding beyond top 11 of spittle container B providing an exposed surface area 22. Exposed surface area 22 enables the user of said cuspidor A to remove funnel section C from container B by grasping exposed surface area 22 and allows the disposal of any retained spittle and the cleaning of spittle container B. Also, protruding funnel section C aids the user in directing the spittle to cuspidor A.

As shown in FIGS. 1,3,4,6,7 and 8 a spittle channel inlet 24 is disposed within top end 16 of funnel section C for receiving spittle. A spittle channel outlet 26 is disposed within bottom end 18 of funnel section C allowing the passage of spittle from the user to the interior of spittle container B. A spittle channel 28 is disposed within exterior funnel wall 20 for directing spittle from spittle channel inlet 24 towards spittle channel outlet 26. In the preferred embodiment, exterior funnel wall 20 is a cylindrical skirt defining hollow interior 29. In this embodiment, an interior funnel wall 30 forms the boundary of spittle channel 28 and defines spittle outlet 26. The hollow cylindrical skirt configuration of exterior funnel wall 20 enables funnel section C to absorb any deforming of spittle container B should an excessive amount of force be exerted inward on spittle container B. This embodiment prevents funnel section C from being ejected from spittle container B when an excessive force is exerted on spittle container B thus maintaining the integrity of cuspidor A's structure.

As shown in FIGS. 2, 4 and 6, cap D includes a cap base 32 and side 34 depending from cap base 32 providing cap D with a given depth and width sufficient to enclose exposed surface area 22 of funnel section C and snugly nestle spittle container B. As shown in FIG. 4, in the preferred embodiment the outside width of spittle container is constant throughout the container thus enabling cap D to be retained on base 14 of spittle container B when cap D is not enclosing funnel section C. This provides the user with an easy means not to lose cap D when using the cuspidor for its intended purpose of retaining spittle.

As shown in FIGS. 1 AND 6, reservoir cap E may be used as a first cap to cover the combination of funnel section C and spittle container B. Reservoir cap E includes a reservoir base 36 and reservoir side 38 depending from reservoir base 36 providing reservoir cap E with a given depth and width sufficient to enclose protruding exposed surface area 22 of funnel section C and snugly nestle spittle container B. Reservoir cap E also includes extending vessel wall 40 which forms a vessel 42 for retaining tobacco and the like. Vessel 40 is spaced from the outer periphery of reservoir base 36 enabling secondary cap F to enclose vessel 42. Secondary cap F is similar to Cap D except depending wall 44 is not as long as depending wall 34 and rests on reservoir base 36 thereby retaining tobacco and the like within vessel 42.

As shown in FIGS. 5 and 6 the combination of secondary cap F, reservoir cap E and funnel section C align with the profile of spittle container B except for the nominal width of the materials used to construct these structures. Accordingly, it is intended that the design of cuspidor A be compact to allow the user to fit cuspidor A comfortably within a pocket. In the preferred embodiment all of these structures will be made from high polymer plastic thereby enabling cuspidor A to be reused. In the preferred embodiment these structures will be colored thus preventing the spittle retained within cuspidor A from being viewed.

Thus, it can be seen that an advantageous construction for a portable cuspidor can be had according to the invention. The portable cuspidor is comprised of a funnel section being suspended within a spittle receptacle through the tapering of their respective components. Such a configuration provides the user with an embodiment which maintains its structural integrity, while providing an easy means for disassembling the cuspidor to enable for the disposal of spittle. Additionally, the structural tapering of the funnel section and spittle container enables the funnel section to be removed from the spittle container repeatedly without subjecting the funnel section to any forces which may deform the funnel wall. However, should the funnel wall become deformed, the tapering configuration maintains structural integrity by allowing the funnel section to continue engaging with the spittle container in frictional contact at a height different than the previous non-deformed height.

While a preferred embodiment of the invention has been described using specific terms, such description is for illustrative purposes only, and it is to be understood that changes and variations may be made without departing from the spirit or scope of the following claims.

What is claimed is:

1. A portable cuspidor for the containment of spittle, said cuspidor comprising:

a hollow elongated spittle container having an open top for receiving and containing said spittle, said container being of a given width having an inside surface;

a removable funnel section having a top end, a bottom end, an exterior funnel wall interconnecting said top end with said bottom end, an interior funnel wall, spaced from said exterior funnel wall, and said exterior funnel wall forming an exterior skirt surrounding said interior funnel wall to define a hollow interior within said funnel section;

said funnel section being suspended and retained within said container by a frictional engagement between a portion of said exterior skirt and said inside surface of said spittle container;

said top end of said funnel section protruding beyond said open top of said spittle container defining an exposed surface area which may be grasped for removing said funnel section from said spittle container;

a spittle channel inlet disposed within said top end of said funnel section for receiving said spittle;

a spittle channel outlet disposed within said bottom end of said funnel section allowing the passage of said spittle from said user to said interior of said spittle container;

a spittle channel disposed within said funnel section for directing said spittle from said spittle channel inlet towards said spittle channel outlet; and said interior funnel wall defining said spittle channel.

2. The cuspidor of claim 1 wherein said inside surface of said spittle container is tapered so that said inside surface has a width which is wider at said top than at a base of said container.

3. The cuspidor of claim 2 wherein said exterior funnel wall of said funnel section is tapered so that said exterior funnel wall has an outside width wider at said top end than at said bottom end.

4. The cuspidor of claim 3 wherein said taper of said inside surface of said spittle container in combination with said taper of said funnel section enables said funnel section and said spittle container to nestle together in a friction environment so that said funnel section is retained in a suspended position within said spittle container.

5. The cuspidor of claim 4 wherein said exterior funnel wall of said funnel section tapers to an outside width greater than a width of said inside surface of said spittle container whereby said funnel section is frictionally engaged within said container enabling said top end of said funnel section to protrude beyond said open top of said spittle container.

6. The cuspidor of claim 1 wherein said exterior funnel wall engages and overlies said inside surface of said spittle container forming a double wall over a portion of the height of said hollow elongated spittle container for retaining said funnel section within said interior of said hollow elongated spittle container and for reinforcing said hollow elongated spittle container.

7. A portable cuspidor for the containment of spittle, said cuspidor comprising:

a hollow elongated spittle container having an open top for receiving and containing said spittle, said container being of a given width having an inside surface;

a removable funnel section having a top end, a bottom end, an exterior funnel wall interconnecting said top end with said bottom end, an interior funnel wall, spaced from said exterior funnel wall, and said exterior funnel wall forming an exterior skirt surrounding said interior funnel wall to define a hollow interior within said funnel section;

said funnel section being suspended and retained within said container by a frictional engagement between a portion of said exterior skirt and said inside surface of said spittle container;

said top end of said funnel section protruding beyond said open top of said spittle container defining an exposed surface area which may be grasped for removing said funnel section from said spittle container;

a spittle channel inlet disposed within said top end of said funnel section for receiving said spittle;

a spittle channel outlet disposed within said bottom end of said funnel section allowing the passage of said spittle from said user to said interior of said spittle container;

a spittle channel disposed within said funnel section for directing said spittle from said spittle channel inlet towards said spittle channel outlet;

said interior funnel wall defining said spittle channel; and a cap having a base and sides depending from said base providing said cap with a given depth, said cap being of a width and depth sufficient to enclose said protruding top portion of said funnel section.

8. The cuspidor of claim 7 wherein said exterior funnel wall engages and overlies said inside surface of said spittle container forming a double wall over a portion of the height of said hollow elongated spittle container for retaining said funnel section within said interior of said hollow elongated spittle container and for reinforcing said hollow elongated spittle container.

9. The cuspidor of claim 7 wherein said cap is of a width slightly wider than said base of said spittle container thereby enabling said cap to be retained superposed over the base of said spittle container.

10. The cuspidor of claim 7 wherein said inside surface of said spittle container is tapered so that said inside surface has a width which is wider at said top than at a base of said container.

11. The cuspidor of claim 10 wherein said side wall of said funnel section is tapered so that said side wall has an outside width wider at said top end that at said bottom end.

12. The cuspidor of claim 11 wherein said taper of said inside surface of said spittle container in combination with said taper of said funnel section enables said funnel section and said spittle container to nestle together in a friction environment so that said funnel section is retained in a suspended position within said spittle container.

13. The cuspidor of claim 12 wherein said exterior funnel wall of said funnel section tapers to an outside width greater than a width of said inside surface of said spittle container whereby said funnel section is frictionally engaged within said container enabling said top end of said funnel section to protrude beyond said open top of said spittle container.

14. A sturdy reusable pocket cuspidor for the temporary containment of spittle and storage of tobacco or the like, said cuspidor comprising:

a hollow elongated spittle container having an open top for receiving and containing said spittle, said container being of a given width having an inside surface;

a removable funnel section having a top end, and a bottom end;

said funnel section being received within said container;

a spittle channel inlet disposed within said top end of said funnel section for receiving said spittle;

a spittle channel outlet disposed within said bottom end of said funnel section allowing the passage of said spittle from said user to said interior of said spittle container;

a spittle channel disposed within said funnel section for directing said spittle from said spittle channel inlet towards said spittle channel outlet;

a reservoir cap having a reservoir base and reservoir side depending from said reservoir base providing reservoir cap with a given depth sufficient to enclose said protruding top portion of said funnel section;

said reservoir cap having an extending vessel wall forming a vessel for storing said tobacco and the like; and a cap having a base and sides depending from said base providing said cap with a given depth, said cap being of a width and depth sufficient to enclose said vessel of said reservoir cap.

15. The cuspidor of claim 14 wherein said inside surface of said spittle container is tapered so that said inside surface has a width which is wider at said top than at a base of said container.

16. The cuspidor of claim 15 wherein said side wall of said funnel section is tapered so that said side wall has an outside width wider at said top end than at said bottom end.

17. The cuspidor of claim 16 wherein said taper of said inside surface of said spittle container in combination with said taper of said funnel section enables said funnel section and said spittle container to nestle together in a friction environment so that said funnel section is retained in a suspended position within said spittle container.

18. The cuspidor of claim 14 wherein said top end of said funnel section protruding beyond the periphery of said spittle container to define an exposed surface area which may be manually grasped for removing said funnel section from said spittle container.

* * * * *